US005691025A

United States Patent [19]

Hardin

[11] Patent Number: 5,691,025

[45] Date of Patent: Nov. 25, 1997

[54] HOLLOW OBJECT CARRYING DIE

[76] Inventor: James D. Hardin, 306 Valley Dr. P.O. Box 6, Rochester, Pa. 15074

[21] Appl. No.: 672,379

[22] Filed: May 28, 1996

[51] Int. Cl.[6] ..... A44B 15/00

[52] U.S. Cl. ..... 428/99; 428/28; 70/456 R

[58] Field of Search ..... 428/99, 28; 70/456 R, 70/457; 63/18, 12, 13

[56] References Cited

U.S. PATENT DOCUMENTS 5,040,394 8/1991 Wang ..... 70/457
5,226,252 7/1993 Haluska ..... 70/456 R

FOREIGN PATENT DOCUMENTS 289690 11/1988 European Pat. Off. ..... 70/456 R

*Primary Examiner*—Alexander Thomas
*Attorney, Agent, or Firm*—Carothers & Carothers

[57] ABSTRACT

A hollow single die, of a pair of dice for carrying an object and having a ring attached to one corner, to which ring is connected, one end of a flexible carrying chain, the other end of the chain being attached to a key carrying ring.

4 Claims, 1 Drawing Sheet

HOLLOW OBJECT CARRYING DIE

BACKGROUND OF THE INVENTION

In the past, no convenient way of safely carrying a small personal item has been provided.

SUMMARY OF THE INVENTION

It is an object of this invention to provide a hollow single die of a pair of hollow dice, which die will serve as a carrier of a personal item, such as a condom or any other item.

DESCRIPTION OF THE PREFERRED EMBODIMENTS

The die comprises two relatively slidable parts so as to be readily openable. Attached to one corner of the die is the end of carrying chain 3. The other end of the chain is attached to a key carrying ring 4 for receiving the keys of the person carrying the die.

Figure 1:
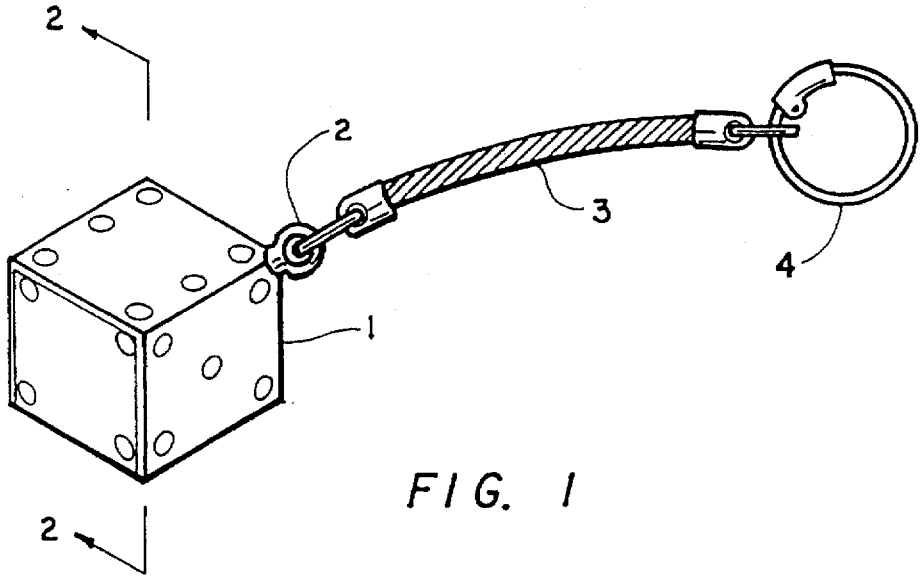
FIG. 1 is a perspective view of the invention.

Referring to FIG. 1, numeral 1 denotes a hollow die having a ring 2 attached to one corner which is attached to one end of a flexible chain 3. The other end of the chain is attached to a key carrying ring 4.

Figure 2:
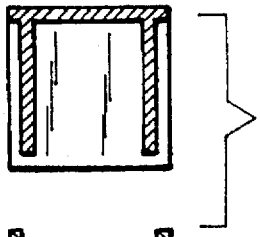
FIG. 2 shows the top part of the die shown in an exploded view of cross section 2—2 in FIG. 1.
Figure 3:
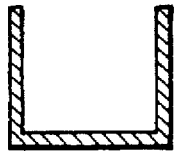
FIG. 3 shows the slidable part of the die in an exploded view of cross section 2—2 in FIG. 1.

FIG. 2 shows the outer die portion which is slidable over the inner die portion, shown in cross-section, in FIG. 3, to enable the die to be slidably opened to receive an object (not shown) and to enable the die to be slidably closed after receiving the object to be carried.

Figure 4:
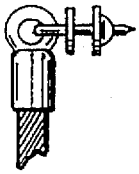
FIG. 4 shows a pin modification substituted for the ring.

FIG. 4 shows a modification in the form of a pierced earring to be substituted for the ring.

Figure 5:
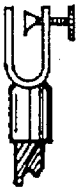
FIG. 5 shows a screw type modification substituted for the ring.

FIG. 5 shows a further modification showing a screw-clamp to be substituted for the ring to be used as a clamped type earring.

Figure 6:
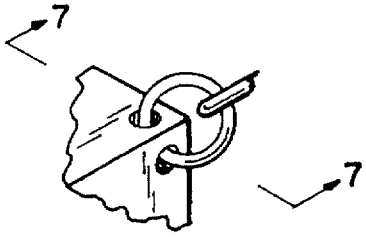
FIG. 6 shows a further modification wherein the carrying end of the chain extends through numbers of the die adjacent one corner thereof.

FIG. 6 shows a further modification wherein the carrying end of the chain extends through one corner of the die.

Figure 7:
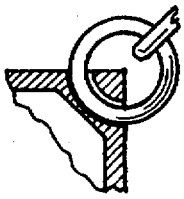
FIG. 7 shows a cross-sectional view 7—7 of FIG. 6 wherein the ring goes through the corner of the die.

FIG. 7 shows a cross-sectional view 7—7 of FIG. 6 wherein the ring goes through the corner of the die, and it shows how the corner of the die is reinforced with extra material so that the hole for the ring does not pierce the interior of the die cavity. This will prevent contaminants from entering the cavity.

I claim:

1. A hollow die of a pair of dice, a ring attached to one corner of said hollow die, a flexible carrying chain secured at one end onto said ring, said hollow die comprising two relatively movable parts to permit introduction into said hollow die of an object to be carried by said hollow die, said relatively moveable parts comprised of slidably inter engageable parts of U-shaped cross section wherein each part provides three of six external die faces of said hollow die.

2. A hollow die as recited in claim 1 wherein said relatively movable parts are relatively slidable, said ring being welded to the outside of said one corner.

3. A hollow die as recited in claim 1 wherein said ring is looped through a hole in the corner of the die.

4. A hollow ring as recited in claim 1 wherein a key chain carrying ring is connected to the other end of said flexible carrying chain.

* * * * *